United States Patent [19]

Takao et al.

[11] Patent Number: 4,785,779

[45] Date of Patent: Nov. 22, 1988

[54] INTERNAL COMBUSTION ENGINE CONTROL APPARATUS

[75] Inventors: Mitsunori Takao; Takashi Arimura; Masao Yonekawa, all of Kariya, Japan

[73] Assignee: Nippondenso Co., Ltd., Kariya, Japan

[21] Appl. No.: 23,985

[22] Filed: Mar. 11, 1987

Related U.S. Application Data

[63] Continuation of Ser. No. 807,025, Dec. 9, 1985, abandoned.

[30] Foreign Application Priority Data

Dec. 11, 1984 [JP] Japan ..... 59-262447

[51] Int. Cl.[4] ..... F02M 3/00

[52] U.S. Cl. ..... 123/339

[58] Field of Search ..... 123/339, 340, 585, 587, 123/588

[56] References Cited

U.S. PATENT DOCUMENTS

| | | | |
|---|---|---|---|
| 4,455,978 | 6/1984 | Atago | 123/339 |
| 4,462,360 | 7/1984 | Kobayashi | 123/339 |
| 4,501,240 | 2/1985 | Aono | 123/339 |
| 4,509,477 | 4/1985 | Takao et al. | 123/339 |
| 4,522,176 | 6/1985 | Takao et al. | 123/339 |
| 4,548,180 | 10/1985 | Yamato | 123/339 |
| 4,580,536 | 4/1986 | Takao et al. | 123/339 |

*Primary Examiner*—Willis R. Wolfe

*Attorney, Agent, or Firm*—Cushman, Darby & Cushman

[57] ABSTRACT

A detector for detecting amount of suction air or rotating speed of an internal combustion engine supplies the detection signal to a control circuit, which supplies a drive signal to an air control valve mounted in a suction pipe of the internal combustion engine in accordance with the detection signal from the detector so that an idling rotating speed of the internal combustion engine is increased to a predetermined speed.

3 Claims, 5 Drawing Sheets

INTERNAL COMBUSTION ENGINE CONTROL APPARATUS

This is a continuation of application Ser. No. 807,025 filed Dec. 9, 1985, now abandoned.

BACKGROUND OF THE INVENTION

The present invention relates to an internal combustion engine control apparatus, and more particularly to an internal combustion engine control apparatus for controlling an idling operation condition of an automobile internal combustion engine.

In recent years, demands to reduce fuel consumption in an internal combustion engine to improve a cost-performance have been increasing more and more and the reduction of fuel consumption in an idling operation of the internal combustion engine has been studied from various points. For example, in order to reduce the fuel consumption in the idling operation, efforts have been made to reduce a mechanical friction of the internal combustion engine. Because of an improvement in machining precision and assembly precision for a friction surface of a cylinder of the internal combustion engine and use of a sliding member having a high boundary lubrication characteristic, a mechanical loss in a modern internal combustion engine has been significantly lowered compared to that of the prior art engine. After operation for a certain period, for example after a run of 500 km, the mechanical friction is further reduced compared to that at the time of shipment. In a certain automobile internal combustion engine, a suction pipe pressure in the idling operation is less than 200 mm Hg. In this manner, the rotation speed of the internal combustion engine in the idling operation has been lowered.

The reduction of the suction pipe pressure means the reduction of amount of suction air per cylinder of the internal combustion engine, and it causes the following problem.

As the amount of suction air per cylinder reduces, the operation enters a loss of ignition region in which combustion propagation is prevented and combustion is astable even if an air-to-fuel ratio is a theoretical one. In the loss of ignition region, a variation of an output torque of the internal combustion engine is large and the idling rotating speed is not stable. This imparts an uncomfortable feeling to a driver and finally may lead to loss of ignition.

It has been known that under a given suction pipe pressure, the higher the air-to-fuel ratio is, the less does the loss of ignition take place. In Japanese Examined Utility Model Publication No. 57-26035, the idling operation is detected from a time duration of a pulse signal applied to a fuel jet valve and decreasing the air-to-fuel ratio during the idling operation. In this method, since the air-to-fuel ratio is always lower during the idling operation, an exhaust gas condition is degraded and the fuel consumption rather increases.

SUMMARY OF THE INVENTION

It is an object of the present invention to provide an internal combustion engine control apparatus in which a target rotating speed in an idling operation is increased in accordance with an operating condition because, a higher the rotating speed of the internal combustion engine allows less loss of ignition therefore, so that a variation of an output torque and the loss of ignition which may otherwise occur as the amount of suction air in the idling operation are prevented.

In order to achieve the above object, the present invention provides the internal combustion engine control apparatus as shown in FIG. 6 which comprises;

operation condition detection means for detecting an operation condition of an internal combustion engine, air control valve arranged in a suction path of the internal combustion engine for controlling amount of suction air in an idling operation, and drive means for driving the air control valve in accordance with that data of the data detected by the operation condition detection means which is usable to detect a loss of ignition region of the internal combustion engine in the idling operation.

DESCRIPTION OF THE PREFERRED EMBODIMENTS

Figure 1:
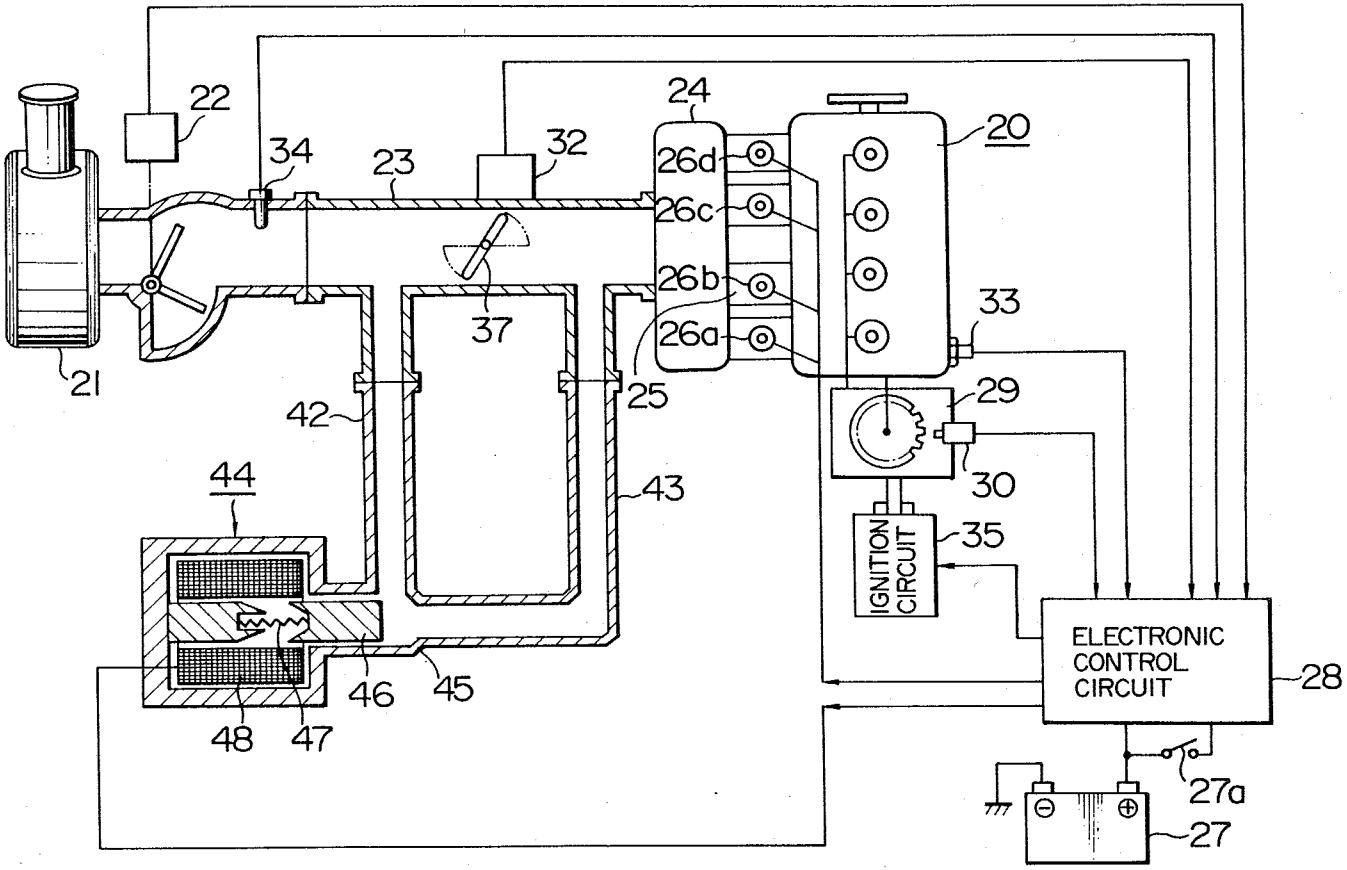
FIG. 1 shows an engine and peripheral elements in one embodiment of the present invention.
Figure 2:
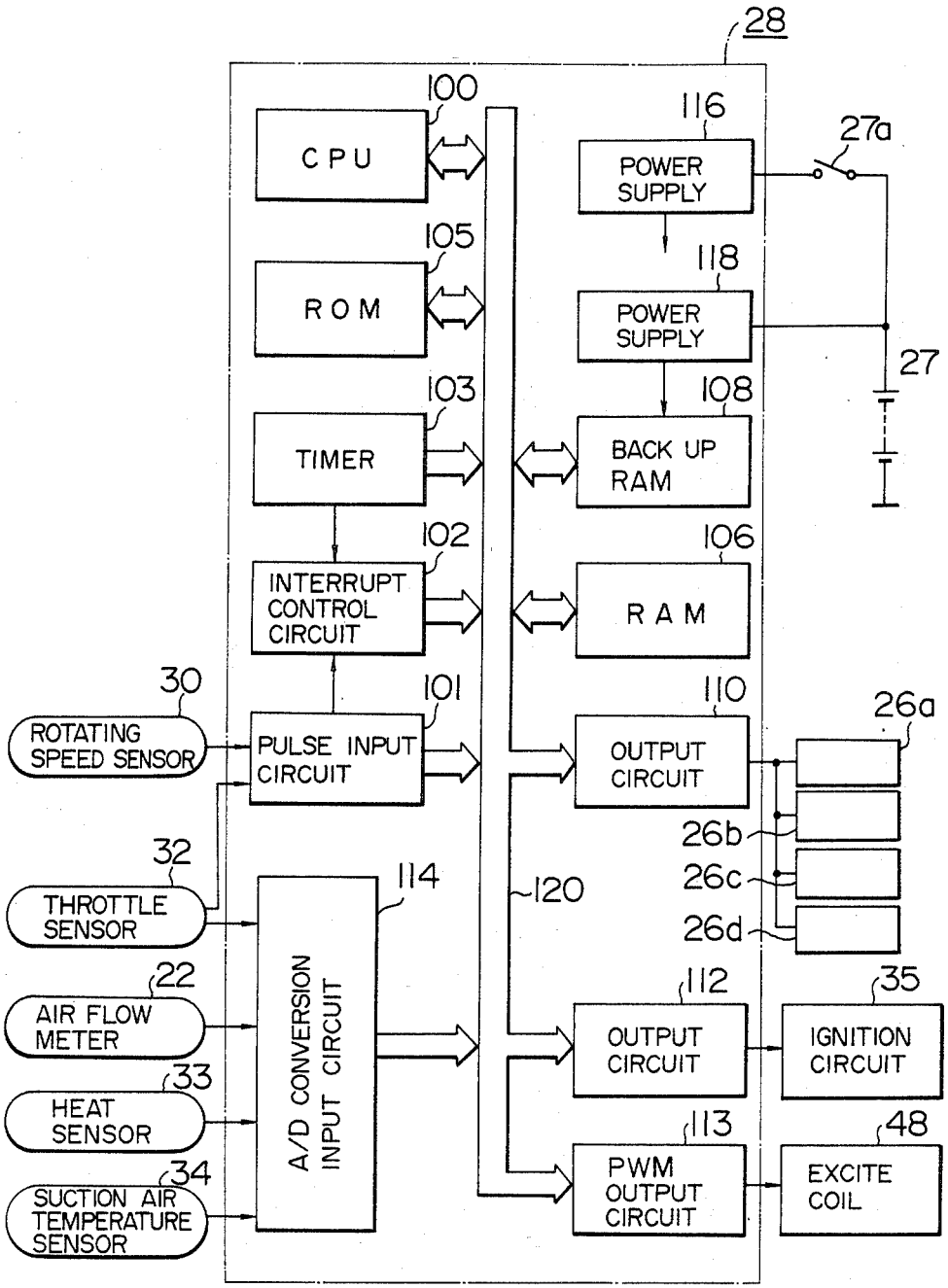
FIG. 2 shows a control diagram including a block diagram of an electronic control circuit.

FIG. 1 shows an internal combustion engine and peripheral elements, and FIG. 2 shows a control diagram including a block diagram of an electronic control circuit.

Numeral 20 denotes a four-cylinder four-cycle ignition type engine. Air is sucked into each cylinder through air cleaner 21, air flow meter 22, suction pipe 23, surge tank 24 and suction manifold 25. On the other hand, fuel is supplied from a fuel tank, not shown, and injected from fuel injection valves **26*a*, 26*b*, 26*c* and 26*d* arranged in the suction manifold 25. An electronic control circuit 28 is energized by a power of a battery 27 through a key switch 27*a*. It determines an operation condition of an engine 20 based on a rotating speed of the engine 20 detected by a rotating speed sensor 30 arranged in a distributor 29 and output signals from the air flow meter 22, a throttle sensor 32, a heat sensor 33 and a suction air temperature sensor 34, and determines an ignition timing of the engine 20 and amount of fuel injection. The rotating speed sensor 30 is mounted on a ring gear which is rotated in synchronism with a crank shaft of the engine 20 and produces 24 pulse signals per revolution of the engine 20, that is, 720° CA in proportion to the rotating speed of the engine. The throttle sensor 32 produces an analog signal which represents an opening of a throttle valve 37 and an ON-OFF signal from an idle switch to indicate that the throttle valve 37 is essentially fully closed. The heat sensor 33 and the suction air temperature sensor 34 are temperature sensors such as thermistors. The heat sensor 33 detects a coolant temperature which represents an engine temperature, and the suction air temperature sensor 34 detects a temperature of the suction air. The distributor 29 supplies high voltage ignition signals generated by an ignition circuit 35 to four ignition plugs mounted in the cylinders. The ignition circuit 35 is controlled by the electronic control circuit 28, which instructs the ignition timing and energization period. The ignition circuit 35** comprises an igniter and an ignition coil.

Air pipes 42 and 43 are arranged to bypass the throttle valve 37. The air pipes 42 and 43 are connected through an air control valve 44, which is basically a linear solenoid control valve and controls an area of air path between the air pipes 42 and 43 by a position of a plunger 46 which is movably mounted in a housing 45. The plunger 46 of the air control valve 44 is normally set by a compression coil spring 47 to close the air path, and when an exciting current is supplied to an excite coil 48, the plunger 46 is driven to open the air path. By continuously changing the exciting current to the excite coil 48, the amount of bypass air is controlled. The exciting current to the excite coil 48 is controlled by pulse width modulation which controls a duty factor of a pulse applied to the excite coil 48.

The air control valve 44 is controlled by the electronic control circuit 28 as are the fuel injection valves 26*a* to 26*d*.

Referring to FIG. 2, the configuration of the electronic control circuit 28 is explained. Numeral 100 denotes a central processing unit (CPU) which calculates the ignition timing, the amount of fuel injection and the duty factor of the pulse to be applied to the air control valve 44 in accordance with a predetermined program, numeral 101 denotes a pulse input circuit which receives the pulse signal from the rotating speed sensor 30 and the ON/OFF signal from the idle switch (not shown) in the throttle sensor 32, numeral 102 denotes an interrupt control circuit which generates an interrupt pulse at a predetermined crank angle in response to the pulse signal supplied by the pulse input circuit, numeral 103 denotes a timer for measuring a time, numeral 105 denotes a read-only memory (ROM) which prestores programs and data, numeral 106 denotes a readable and writable memory (RAM) which temporarily stores data, numeral 108 denotes a backup RAM which retains the content of the stored data even after the key switch 27*a* is turned off, numeral 110 denotes an output circuit 5 which drives the fuel injection valves 26*a*–26*d*, numeral 112 denotes an output circuit which drives the ignition circuit 35 to control the ignition timing of the engine 20, numeral 113 denotes a PWM output circuit which controls the duty factor of the output voltage to the excite coil 48 of the air control valve 44, numeral 114 denotes an A/D conversion input circuit which converts the analog signals from the air flow meter 22, heat sensor 33, throttle sensor 32 and suction air temperature sensor 34 to 8-bit digital signals, numeral 116 denotes a power supply which supplies a constant voltage to the electronic control circuit 28, from a battery 27 through the key switch 27*a*, numeral 118 denotes another power supply which is connected to the battery 27 without routing the key switch 27*a* and supplies a power to the backup RAM 108, and numeral 120 denotes a data bus which connects the above circuits. The output circuit 110 has a counter (not shown) which, when set to a fuel injection time $\tau$ by the CPU 100, counts down at a predetermined timing and opens the fuel injection valve until the count reaches zero.

Figure 3:
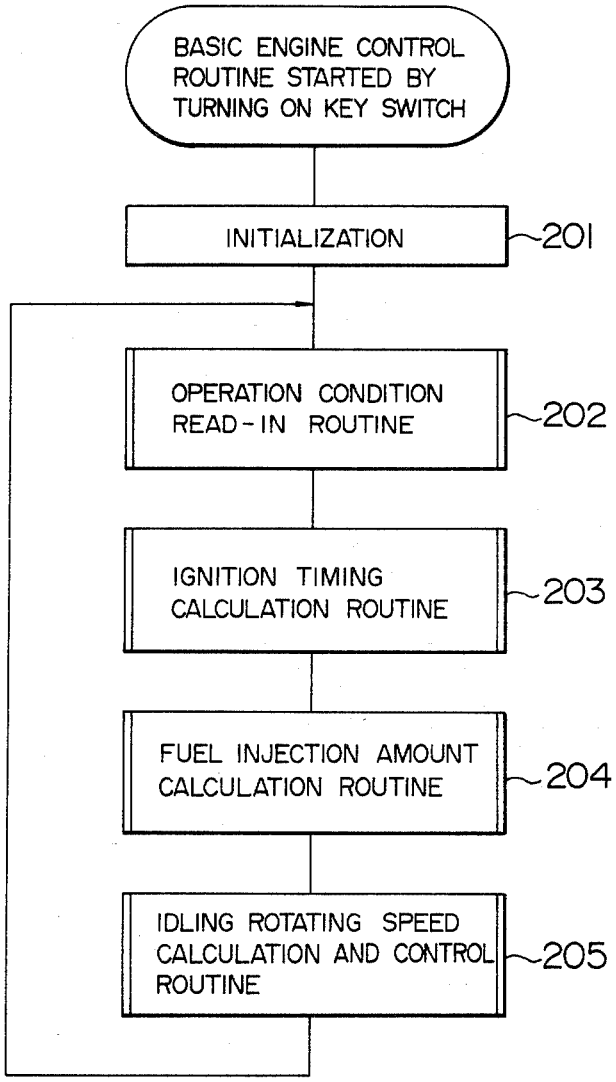
FIG. 3 is a flow chart of a basic engine control in the embodiment of the present invention.

In the present embodiment, a basic engine control routine shown in FIG. 3 is executed in the engine 20 and the peripheral elements shown in FIGS. 1 and 2. The engine control routine includes an idling rotating speed calculation control routine.

In the present embodiment, the electronic control circuit 28 starts to control when the key switch 27 is turned on. In FIG. 3, in an initialization step 201, the internal registers are cleared and the parameters are initialized. Then, steps 202 to 205 are repeatedly carried out. The step 202 is an operation condition read-in routine in which the operation condition of the engine 20, that is, the suction air amount Q, engine rotating speed N, suction air temperature THA, throttle opening and engine temperature are read from the air flow meter 22, rotating speed sensor 30, suction air temperature sensor 34, throttle sensor 32 and heat sensor 33, respectively. The data read in the step 202 are used in the ignition timing calculation routine (step 203), fuel injection amount calculation routine (step 204) and idling rotating speed calculation and control routine (step 205). The step 203 is a well-known ignition timing calculation routine which calculates the ignition timing of the engine 20 as an optimum advance angle (MBT) and corrects the timing for the idling operation as required. In the interrupt routine (not shown) which is started by the pulse supplied from rotating speed sensor 30 at every 30° CA, the ignition circuit 35 is energized through the output circuit 112 at the ignition timing determined in the step 203, to generate a high voltage to ignite the air-fuel mixture in each cylinder. The step 204 is a well-known fuel injection amount calculation routine which corrects a basic fuel injection amount calculated based on a load (Q/N) of the engine 20 by the temperature of the engine 20 to determine the fuel injection amount. In this routine, the fuel injection amount is set in the counter (not shown) in the output circuit 110 as a fuel injection period $\tau$ for the rotating speed of the engine 20.

The step 205 is an idling rotating speed calculation and control routine which controls the suction air amount to control the rotating speed of the engine 20 when the engine 20 is in the idling condition. It includes correction means for the target rotating speed in the loss of ignition area or an area very close thereto, based on the suction air amount Q/N per revolution.

The ignition timing calculation routine and the fuel injection amount calculation routine are well known and the explanation thereof is omitted. The idling rotating speed calculation and control routine of the step 205 which is a main step in the present embodiment is explained with reference to FIG. 4.

Figure 4:
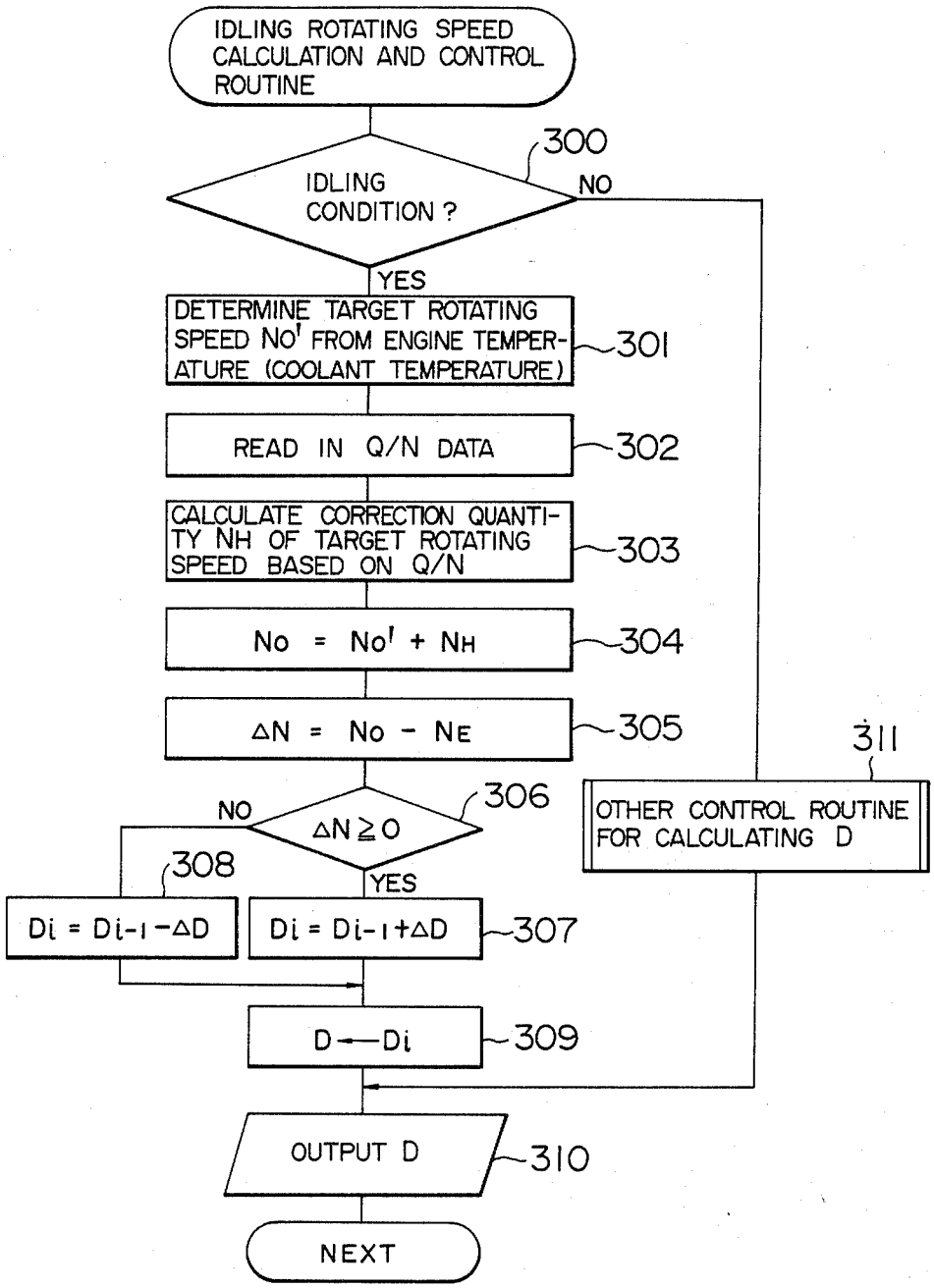
FIG. 4 is a flow chart of an idling rotating speed calculation control routine shown in FIG. 3.

FIG. 4 shows a flow chart of the idling rotating speed calculation and control routine. In a step 300, when the idle switch in the throttle sensor 32 is ON and the rotating speed $N_E$ of the engine 20 is lower than a predetermined value, it is determined that the operation condition of the engine 20 is idle.

Figure 5:
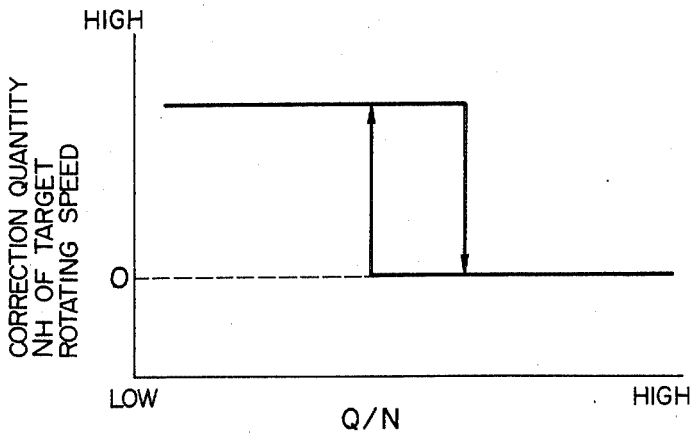
FIG. 5 is a map of amount of suction air per revolution of engine to correction amount retrieved in the idling rotating speed calculation control routine.
Figure 6:
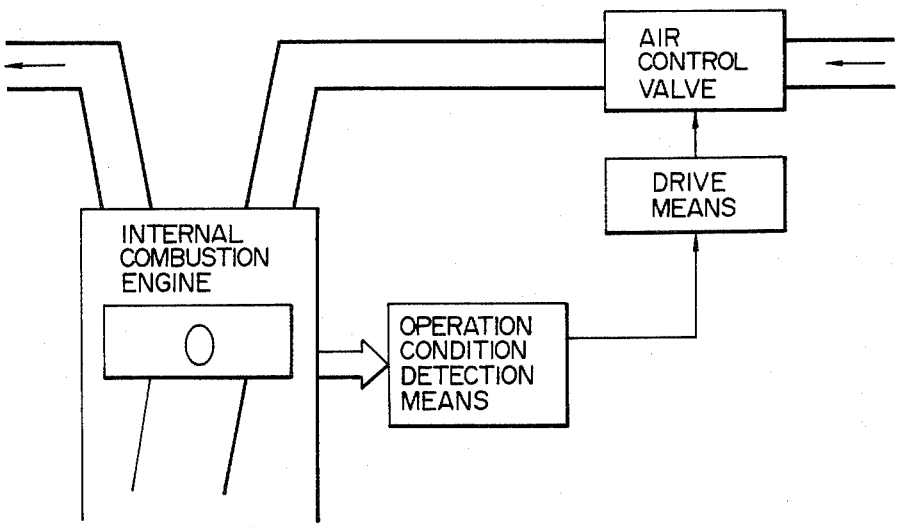
FIG. 6 is block diagram of a basic configuration of the present invention.

In a step 301 and subsequent steps, the rotating speed of the engine 20 in the idling condition is feedback-controlled to a predetermined target rotating speed. In the step 301, the temperature of the engine 20 is detected by the temperature sensor 33 from a map of engine temperature (engine coolant temperature) versus target rotating speed No', and the target rotating speed No' is determined based on the engine temperature. The target rotating speed No' is set such that it is high when the engine coolant temperature is low and vice versa. In a step 302, the Q/N data obtained in the fuel injection amount calculation routine of the step 204 in FIG. 3 is read from a predetermined address. In a step 303, a correction quantity $N_H$ is determined for Q/N read in the step 302 by a map of Q/N versus correction quantity $N_H$ for the target rotating speed shown in FIG. 5. The map for the correction quantity $N_H$ is switched in two stages for Q/N as shown in FIG. 5. As Q/N reduces, the correction quantity $N_H$ increases to stabilize the combustion. The correction quantity $N_H$ increases when Q/N is lower than a first predetermined value, and decreases when Q/N is higher than a second predetermined value which is higher than the first predetermined value. Thus, the correction quantity $N_H$ shows a hysteresis to Q/N. In a step 304, a final target rotating speed No ($=N_o'+N_H$) is calculated based on the target rotating speed $N_o'$ and the correction quantity $N_H$ therefor obtained in the steps 301 and 303. In a step 305, a difference $\Delta N$ between the final target rotating speed. No obtained in the step 304 and the current engine rotating speed $N_E$ is calculated. In a step 306, whether the difference $\Delta N$ is larger than zero or not is checked. If the decision in the step 306 is YES, that is, if $\Delta N$ is larger than zero, it means that the rotating speed $N_E$ of the engine 20 is lower than the final target rotating speed $N_o$ and a step 307 is carried out. In the step 307, a duty factor Di of the drive voltage from the excite coil 48 of the air control valve 44 is increased by adding a predetermined amount $\Delta D$ to a value $D_{i-1}$ which was obtained in the previous control routine. On the other hand, when the decision in the step 306 is $N_o$ ($\Delta N$ is no larger than zero), it means that the engine rotating speed $N_E$ is higher than the final target rotating speed $N_o$ and a step 308 is carried out. In the step 308, the duty factor $D_i$ is decreased by $\Delta D$. After the step 307 or 308, a step 309 is carried out. In the step 309, the duty factor of the voltage signal to be applied to the excite coil 48 of the air control valve 44 is set as a signal D to be supplied to the PWM output circuit 113. In a step 310 following to the step 309, the signal D set in the step 309 is supplied to the PWM output circuit 113 so that the duty factor of the voltage signal applied to the excite coil 48 of the air control valve 44 is changed and the area of the opening of the air control valve 44 is controlled to increase or decrease the suction air amount. After the step 310, a NEXT step is carried out to terminate the present control routine.

When the decision in the step 300 is no, that is, the engine 20 is not in the idling condition, the feedback control is not effected and a step 311 is carried out. For example, when the throttle valve 37 starts to be opened from its fully closed state, the air amount sucked through the bypass path of the air pipes 42 and 43 is controlled to prevent rapid change of the suction air amount and the signal D to be supplied to the PWM output circuit 113 is determined. Then, the step 310 is carried out to control the opening of the air control valve 44.

In the present embodiment, when the suction air amount $\theta/N$ per revolution of the engine 20 in the idling condition is lower than the predetermined value, that is, when the operation condition is in the loss of ignition region or very close thereto, the opening of the air control valve 44 is opened so that the rotating speed of the engine 20 is controlled to the final target rotating speed No corrected by the correction quantity $N_H$ for $\theta/N$ in the idling rotating speed calculation and control routine. Thus, the suction air amount $\theta$ is increased, $\theta/N$ is increased accordingly, and the fuel injection amount determined by the fuel injection amount calculation routine of the step 204 in FIG. 3 is increased, and the rotating speed of the engine 20 is increased to the final target rotating speed $N_0$.

Under the present control, if the operation enters or possibly enters the loss of ignition region, the suction air amount is immediately increased and the fuel amount is also increased accordingly. As a result, the rotating speed of the engine 20 increases and the variation of the output torque of the engine 20 and the loss of ignition are prevented, and the rotation is stable and no uncomfortable feeling is imparted to a driver.

In the present embodiment, the correction quantity $N_H$ is set for the suction air amount $\theta/N$ per revolution of the engine 20 in the idling rotating speed calculation and control routine. Instead of $\theta/N$, the fuel injection period $\tau$ obtained in the fuel injection amount calculation routine, that is, the pulse width of the fuel injection drive pulse applied to the fuel injection valve 26 may be used. In this case, when the fuel injection period $\tau$ is short, the correction quantity $N_H$ is large, and when the fuel injection period $\tau$ is long, the correction quantity $N_H$ is small.

In the present embodiment, the air amount is directly measured by the air flow meter 2 (mass flow type) and the correction quantity $N_H$ is set for $\theta/N$ in the idling rotating speed calculation and control routine. In a speed density type apparatus in which the air amount is indirectly measured by measuring the suction pipe pressure, the correction quantity $N_H$ may be set for the suction pipe pressure. In this case, the correction quantity is small and large when the suction pipe pressure is high and low, respectively.

In the present embodiment, the correction quantity $N_H$ shown in FIG. 5 in the idling rotating speed calculation and control routine is switched in two stages for $\theta/N$, although it may be switched in three or more stages or it may be linearly varied.

In the present embodiment, the air control valve 44 is the linear solenoid. Alternatively, it may be a diaphragm controlled value or stepping motor controlled valve which is operated to follow the control of the idling rotating speed calculation and control routine. Alternatively, it may be a simple ON/OFF type valve (VSV) which is opened when the rotating speed is lower than the target rotating speed and closed when the rotating speed is higher than the target rotating speed. A further simple structure may be used, that is, the simple ON/OFF valve (VSV) may be opened or closed in accordance with the $\theta/N$ value.

In the present embodiment, the air control valve 44 is arranged in the middle of the air pipes 42 and 43 which bypass the throttle valve 37 of the suction pipe 23. Alternatively, the throttle valve 37 may also function as the air control valve 44 and it may be operated in the idling operation in accordance with the idling rotating speed calculation and control routine. In this case, the throttle valve 37 may be driven by a pulse motor in the idling condition.

As described above, the present invention provides the internal combustion engine control apparatus which comprises the operation condition detection means for detecting an operation condition of the internal engine, the air control valve arranged in the suction air path of the internal combustion engine to control the suction air amount in the idling condition, and drive means for driving the air control valve in accordance with that data of the data detected by the operation condition detection means which is usable to detect the loss of ignition region of the internal combustion engine in the idling condition. When the suction pipe pressure drops, that is, the suction air amount per cylinder of the internal combustion engine decreases in the idling condition and the operation condition enters or very closely approaches the loss of ignition region where the combustion is astable, the air control valve which controls the suction air amount in the idling condition is opened in accordance with the data which is usable to detect the loss of ignition region, for example, suction air amount $\theta/N$ per revolution of the internal combustion engine, suction pipe pressure or the pulse width of the fuel injection valve drive pulse applied to the fuel injection valve so that the rotating speed is controlled to the target rotating speed which is higher by the predetermined correction quantity. As a result, $\theta/N$ is increased, the fuel supply from the fuel injection valve is increased, the combustion is stabilized, the uncomfortable feeling to the driver is eliminated and the loss of ignition is prevented. Since the air amount is increased, the degradation of the exhaust gas is avoided and the combustion is controlled at the theoretical air-to-fuel ratio, and the increase of the fuel consumption is avoided. The idling operation at a high elevation place where the loss of ignition apts to occur can be stabilized without using an atmospheric pressure sensor.

We claim:

1. An internal combustion engine control apparatus comprising:

idling operation condition detection means for detecting an idling operation condition of an internal combustion engine in which said engine is idling;

rotational speed detection means for detecting a rotational speed of the engine;

comparing means for comparing the rotational speed detected by said rotational speed detection means with a predetermined target idle rotation value at a time when said idling operation condition detection means detects said idling operation condition;

control means, responsive to a comparison result of said comparing means, for controlling an idling speed of said engine such that the detected rotational speed coincides with said predetermined target rotating value;

operation parameter detection means for detecting an operation parameter indicative of amount of air intake into cylinders of the engine when said idling operation condition detection means detects said idling operation condition and said rotational speed detected by said rotational speed rotational speed detection means is lower than a preset rotational speed; and correction means for correcting the target idle rotation value used by said comparing means by increasing said target rotating value when a loss of ignition region is detected, said loss of ignition region indicated by said operation condition parameter detected by said operation condition parameter detection means being lower than a predetermined value, wherein said control means includes means for increasing said target rotating value when said operation parameter becomes lower than a first predetermined value, and means for continuously increasing said target rotating value until said operation parameter exceeds a second predetermined value greater than the first predetermined value.

2. A control apparatus according to claim 1 wherein the operation parameter detected by said operation parameter detection means is a parameter from the group of parameters consisting of a suction air amount per one rotational speed of the engine Q/N, a pressure within a suction air pipe, or a pulse width of a fuel injection valve driving pulse applied to a fuel injection valve.

3. A control apparatus according to claim 1 further comprising:

warming-up condition detection means for detecting a warming condition of the engine, and wherein the target rotating speed associated with said control means is determined on the basis of the warm-up condition detected by said warming-up condition detection means.

* * * * *